US007559954B2

(12) United States Patent
Craamer

(10) Patent No.: US 7,559,954 B2
(45) Date of Patent: Jul. 14, 2009

(54) METHOD AND DEVICE FOR DIGITALLY UPGRADING TEXTILE

(75) Inventor: Johannes Antonius Craamer, Ijlst (NL)

(73) Assignee: Ten Cate Advances Textiles B.V., Nijverdal (NL)

( * ) Notice: Subject to any disclaimer, the term of this patent is extended or adjusted under 35 U.S.C. 154(b) by 0 days.

(21) Appl. No.: 10/571,995

(22) PCT Filed: Sep. 22, 2004

(86) PCT No.: PCT/EP2004/010732

§ 371 (c)(1),
(2), (4) Date: Mar. 15, 2006

(87) PCT Pub. No.: WO2005/028730

PCT Pub. Date: Mar. 31, 2005

(65) Prior Publication Data

US 2007/0061980 A1 Mar. 22, 2007

(30) Foreign Application Priority Data

Sep. 22, 2003 (NL) ..... 1024338
Nov. 28, 2003 (WO) ..... PCT/NL03/00841

(51) Int. Cl.
*C11D 3/00* (2006.01)

(52) U.S. Cl. ..... 8/115.51; 8/151; 68/5 E; 226/96; 347/2; 347/77

(58) Field of Classification Search ..... 8/115, 8/151, 115.51; 442/59; 427/469; 347/77, 347/2; 226/96; 68/5 E
See application file for complete search history.

(56) References Cited

U.S. PATENT DOCUMENTS 3,271,102 A * 9/1966 Morgan ..... 8/151
3,601,299 A * 8/1971 Murer et al. ..... 226/96
3,717,722 A 2/1973 Messner
3,776,004 A * 12/1973 Fleissner ..... 68/5 E
4,324,117 A 4/1982 Schwob et al.

(Continued)

FOREIGN PATENT DOCUMENTS

DE 19930866 2/2000

(Continued)

*Primary Examiner*—Lorna M Douyon
*Assistant Examiner*—Khanh Tuan Nguyen
(74) *Attorney, Agent, or Firm*—David P. Owen; Howrey LLP

(57) ABSTRACT

The invention provides a method for digitally upgrading a textile article (T) using a textile upgrading device (1), the device (1) comprising a number of nozzles (12) for applying one or more substances to the textile (T), in addition to transport means (2) for transporting the textile (T) along the nozzles (12), wherein the nozzles (12) are ordered in a number of successively placed rows (4, 5, 6, 7) extending transversely of the transporting direction of the textile article (T), the method comprising the steps of: guiding the textile article (T) along a first row (4) of nozzles (12); performing with the first row (4) of nozzles (12) one of the operations of painting, coating or finishing of the textile article (T) carried therealong; subsequently guiding the textile (T) along a second row (5) of nozzles (12); and performing with the second row (5) of nozzles (12) another of the operations of painting, coating or finishing of the textile article (T) carried therealong.

21 Claims, 3 Drawing Sheets

U.S. PATENT DOCUMENTS

| | | | | | |
|---|---|---|---|---|---|
| 4,347,521 | A | * | 8/1982 | Teumer | 347/77 |
| 4,501,038 | A | | 2/1985 | Otting | |
| 4,547,921 | A | * | 10/1985 | Otting et al. | 8/151 |
| 4,580,304 | A | | 4/1986 | Otting et al. | |
| 4,650,694 | A | | 3/1987 | Dressler et al. | |
| 4,702,742 | A | | 10/1987 | Iwata et al. | |
| 4,791,434 | A | | 12/1988 | Wills | |
| 4,841,307 | A | * | 6/1989 | Graham | 347/2 |
| 6,120,560 | A | | 9/2000 | Miller et al. | |
| 6,450,694 | B1 | * | 9/2002 | Gregory | 385/53 |
| 2001/0046826 | A1 | | 11/2001 | Tebbe | |
| 2003/0081094 | A1 | | 5/2003 | Van Veen et al. | |
| 2003/0117471 | A1 | | 6/2003 | Sharma | |

FOREIGN PATENT DOCUMENTS

| | | | | |
|---|---|---|---|---|
| EP | 0941853 | A2 | | 9/1999 |
| EP | 1048466 | | | 11/2000 |
| GB | 2187419 | | | 9/1987 |
| JP | 60-157867 | | * | 8/1985 |
| JP | 61-146831 | | | 7/1986 |
| JP | 61-152874 | | | 7/1986 |
| JP | 63-85156 | | | 4/1988 |
| JP | 50-51876 | | | 3/1993 |
| JP | 06-220781 | | * | 8/1994 |
| JP | 10-140451 | | | 5/1998 |
| WO | WO02/064877 | | | 8/2002 |

* cited by examiner

METHOD AND DEVICE FOR DIGITALLY UPGRADING TEXTILE

CROSS REFERENCE TO RELATED APPLICATIONS

This application claims priority from Dutch application number 1024335 filed on 22 Sep. 2003 and also from PCT application No PCT/NL03/00841 filed on 28 Nov. 2003, the contents of both of which are hereby incorporated by reference in their entirety.

BACKGROUND OF THE INVENTION

1. Field of the Invention

The present application relates to a method and device for digitally upgrading textile.

2. Description of the Related Art

Roughly five production stages can be distinguished in the production of textiles. The fibre production, spinning of the fibres, the manufacture of cloth (for instance woven or knitted fabrics, tufted material or felt and non-woven materials), the upgrading of the cloth and the production or manufacture of end products. Textile upgrading is a totality of operations which have the purpose of giving textile the appearance and physical characteristics that are desired by the user. Textile upgrading comprises of, among other things, preparing, bleaching, optically whitening, colouring (painting and/or printing), coating and finishing a textile article.

The conventional process for upgrading textile is built up (FIG. 1) of a number of part-processes or upgrading steps, i.e. pre-treating the textile article (also referred to as the substrate), painting the substrate, coating the substrate, finishing the substrate and the post-treatment of the substrate.

A known technique for printing textile is the so-called template technique. Ink is herein applied to cut-out leaves or elements, the templates, with which desired patterns such as letters and symbols can be applied to the substrate. Another known technique for printing textile is the so-called flatbed press technique, wherein the printed image lies in one plane with the parts of the print mould not forming a printing area. An example hereof is a so-called offset print, wherein the printing process takes place indirectly. During the printing the print area is first transferred onto a rubber fabric tensioned round a cylinder and from there onto the material for printing. A further technique is screen-printing, wherein the substance for applying is applied through openings in the print template onto the textile for printing.

The above described techniques all relate to the upgrading step of printing a substrate, in particular textile, or, in other words, they relate to the application of a pattern of a coloured substance to the substrate.

As is already indicated in FIG. 1, painting of the substrate is another upgrading step. Painting is the application of a coloured chemical substance in a full plane, and then uniformly in one colour. Painting takes place at present by immersing the textile article in a paint bath, whereby the textile is provided on both sides with a coloured substance.

Another upgrading step is coating of textile. Coating of textile involves the application of an optionally (semi-)permeable thin layer to the textile to protect (and increase the durability of) the substrate. The usual techniques for applying a coating on solvent or water basis are the so-called knife-over-roller, the dip and the reverse roller coaters. A dispersion of a polymer substance in water is usually applied to the cloth and excess coating is then scraped off with a doctor knife.

A further upgrading step involves finishing of the textile. Finishing is also referred to as high-quality upgrading and involves changing the physical properties of the textile and/or the substances applied to the textile, with the object of changing and/or improving the properties of the substrate. Properties it is wished to achieve with finishing are, among others, softening of the surface of the substrate, making the substrate fireproof or flameproof, water-repellent and/or oil-repellent, non-creasing, shrink-proof, rot-proof, non-sliding, fold-retaining and/or antistatic. A technique frequently used for finishing is foularding (impregnating and pressing).

Each of the upgrading steps shown in FIG. 1 consists of a number of operations. Diverse treatments with diverse types of chemicals are required, depending on the nature of the substrate and desired end result. For the upgrading steps of printing, painting, coating and finishing four recurring steps can generally be distinguished which often take place in the same sequence. These treatments are referred to in the professional field as unit operations. These are the treatments of impregnation (i.e. application or introduction of chemicals), reaction/fixing (i.e. binding chemicals to the substrate), washing (i.e. removing excess chemicals and auxiliary chemicals) and drying.

One drawback of the usual methods of upgrading is that per upgrading step (painting, coating, finishing) two or more cycles of unit operations have to be carried out to achieve the desired result. Three or more cycles of unit operations are often necessary for coating, which entails a relatively high environmental impact, a long throughput time and relatively high production costs. Four or more cycles of unit operations are even required for painting. The traditional painting process has for instance the final operations of several rinses (washing and soaping) for rinsing out excess chemicals, such as for instance thickening agent. Rinsing results in the use of much water. Following on from the rinses is a drying process, usually consisting of a mechanical drying step using press-out rollers and/or vacuum systems followed by a thermal drying step, for instance using tenter-frames.

It is moreover usual at this moment to carry out the different upgrading steps of the textile in separate devices. This means that for instance the painting is performed in a number of paint baths specially suitable for the purpose, the printing and coating are carried out in separate printing devices and coating machines, while finishing is carried out by yet another device. Because the different operations are carried out individually in separate devices, the treating of the textile requires a relatively large area, usually spread over different room areas.

It is an object of the present invention to provide a method for upgrading, i.e. painting, coating and/or finishing, a substrate of textile where the above stated drawbacks and other drawbacks associated with the prior art are obviated.

BRIEF SUMMARY OF THE INVENTION

According to the invention a method is provided for this purpose for digitally upgrading textile articles, using an upgrading device, the device comprising a number of nozzles for applying one or more substances to the textile, in addition to a conveyor for transporting the textile along the nozzles, wherein the nozzles are ordered in a number of successively placed rows extending transversely of the transporting direction of the textile article, the method comprising the steps of:

guiding the textile article past a first row of nozzles;

performing with the first row of nozzles one of the operations of painting, coating or finishing of the textile article carried there-past;

subsequently guiding the textile past a second row of nozzles; and performing with the second row of nozzles another of the operations of painting, coating or finishing of the textile article carried there-past;

and repeating the steps for a second textile article wherein the operation carried out by the first and second rows of nozzles is different for the second article.

The method provides the option of applying chemical substances in a concentrated form and with an exact dosage. The desired upgrading result can hereby be achieved in only a single cycle of unit operations. By applying the chemical substances in only one process run using a number of rows of nozzles placed in series, the efficiency per process run is increased considerably. Very uniform layers can also be applied due to the very precise dosage and control of the nozzles which are possible. The relatively high concentration (solution) with which the chemical substances are applied furthermore makes interim drying unnecessary in many cases.

A random operation can be carried out per row of nozzles, i.e. painting, coating or finishing operations can be carried out per row as desired and in random sequence.

The nozzles of the device have a preferably static position, wherein the textile is guided along the nozzles. This enables a relatively high processing speed and very precise forming of patterns. A further advantage of applying the nozzles, with which jets of droplets of a suitable substance are applied, is that it provides the possibility of on-demand delivery. Smaller series of different textile articles can be processed on a single upgrading device without complicated change-over operations which have an environmental impact.

By applying the substances (chemicals in general, paints, coatings, finishes in particular) in the above stated manner, the number of cycles of unit operations (such as impregnation, fixing/reacting, rinsing and drying) involved per upgrading step can be considerably reduced.

Because the textile can undergo different treatments in a single direction, this moreover results in a considerable space-saving. Because paint baths are furthermore no longer required for application of dye (paint), a saving in water of up to about 95% can be achieved. A weight-saving in the dye is also possible in that less dye need be applied to the textile. The manner and quality of applying the dye can further be better controlled.

In the painting of the substrate in the standard manner by immersion thereof in a paint bath the substrate is painted all through. This means that both sides of the substrate are always treated in the same manner. According to a further preferred embodiment however, the substrate can undergo a treatment on one side different from on the other side. To this end the method preferably comprises of transporting the textile along nozzles placed on either side of the textile for double-sided upgrading of the textile. This means for instance that in one transporting movement the textile can be provided on both sides with a colour, wherein the colour on the one side does not have to be the same as the colour on the other side.

In a particular preferred embodiment, the method comprises of painting the textile article with a first row of nozzles, subsequently coating the textile article with a second row of nozzles and finally finishing the textile article with a third row of nozzles.

According to another preferred embodiment, the method comprises of printing the textile article with a first row of nozzles, subsequently coating the textile article with a second row of nozzles and finally finishing the textile article with a third row of nozzles.

In yet another preferred embodiment, the method comprises of painting the textile article with a first row of nozzles, subsequently coating the textile article with a second row of nozzles and finally finishing the textile article with a third row of nozzles.

The latter preferred embodiments make clear that the choice of which treatment steps must be performed and the sequence in which the treatment steps are performed can be modified as required.

Preferably applied for performing a method is a textile upgrading device which makes use of the continuous inkjet and multi-level deflection technique. The substance coming out of the nozzles is herein deflected by an electric field so that the correct amount of substance comes to lie at the correct position. In order to enable directing of the substance droplets by means of an electric field, it is necessary for the droplets to be charged. The method then comprises of:

feeding substance to the nozzles in almost continuous flows;

breaking up the continuous flows in the nozzles to form respective droplet jets;

charging or discharging the droplets;

applying an electric field;

varying the electric field so as to deflect the droplets such that they are deposited at suitable positions on the textile article.

Use of the continuous inkjet method makes it possible to generate 85,000 to 1,000,000 droplets per second per droplet jet. This large number of droplets and a number of mutually adjacent heads over the whole width of the cloth results in a relatively high productivity and quality of the printed patterns. In view of the high spraying speed, a production speed can moreover be realized in principle of about 20 meters per minute using this technology and, in view of the small volume of the reservoirs associated with the nozzles, a colour change can also be realized within a very short time (less than two minutes).

Nor does it necessarily have to be the case that a different treatment step is carried out per row of nozzles. It is likewise possible to have a number of rows of nozzles successively carry out the same treatment steps.

It is moreover possible to connect the nozzles to reservoirs in which only CMYK process colours are arranged. CMYK is the standard colour model used in printing full-colour documents. Only these four basic colours are used in the printing process. When for instance a cyan-coloured substance, a magenta-coloured substance, a yellow-coloured substance and a black substance are arranged successively in random sequence in the reservoirs of at least four rows of nozzles, painting operations with a random final colour can be performed with the four rows of nozzles. It is however also possible to provide said reservoirs with substances of a suitable mixed colour.

As already set forth above, the treatment step of painting comprises of applying the substance substantially uniformly over the width of the textile article. The treatment step of printing comprises of applying one or more patterns of the substance to the textile article. The treatment step of coating comprises of applying the substance in a thin layer to the surface of the textile. The treatment step of finishing comprises of changing the physical properties of the substance previously applied to the textile article and/or of the textile itself. In a further preferred embodiment, the treatment step comprises of irradiating the textile article with infrared radiation for drying thereof. The infrared radiation is preferably emitted by a number of infrared sources arranged between the nozzles.

The method preferably comprises of successively transporting a first textile article along rows of nozzles and causing different treatment steps to be carried out in a predetermined random sequence by the different rows of nozzles, and transporting a second textile article along the rows of nozzles and causing different treatment steps to be carried out in a predetermined other sequence by the different rows. This means that different textile articles can be successively upgraded in different ways. A first textile article can for instance be treated by printing, coating and finishing thereof, while immediately thereafter a textile article is painted, coated and finished. This enables very flexible use of the textile upgrading device.

Preferably, the conveyor is an endless conveyor belt. Furthermore, it is especially desirable that the textile article is securely affixed to the conveyor to prevent shifting thereof. This is particularly important for such cases where accuracy of placement of the droplets is required e.g. for multi-colour printing. In this manner high speed operation may be achieved while ensuring accurate droplet deposition. The textile may be affixed to the conveyor by means of a releasable adhesive.

The method preferably comprises of directing the individual nozzles with a central control. The central control is for instance formed by a computer.

Further advantages, features and details of the present invention will be elucidated on the basis of the following description of a preferred embodiment thereof.

BRIEF DESCRIPTION OF THE DRAWINGS

Reference is made in the description to the annexed figures, in which.

DESCRIPTION OF ILLUSTRATIVE EMBODIMENTS

Figure 1:
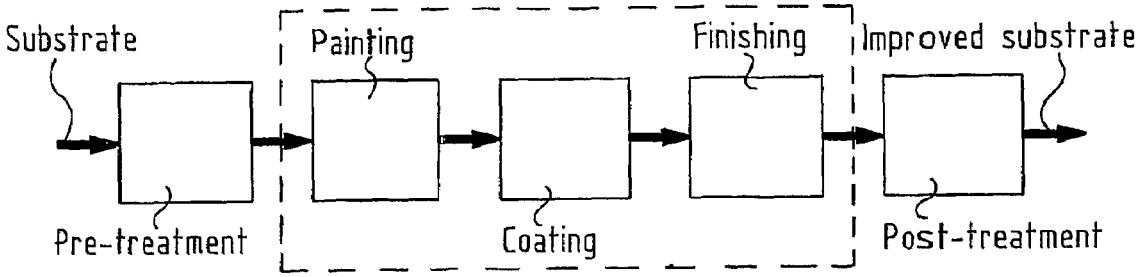
FIG. 1 shows a schematic block diagram of the process of upgrading a substrate.
Figure 2:
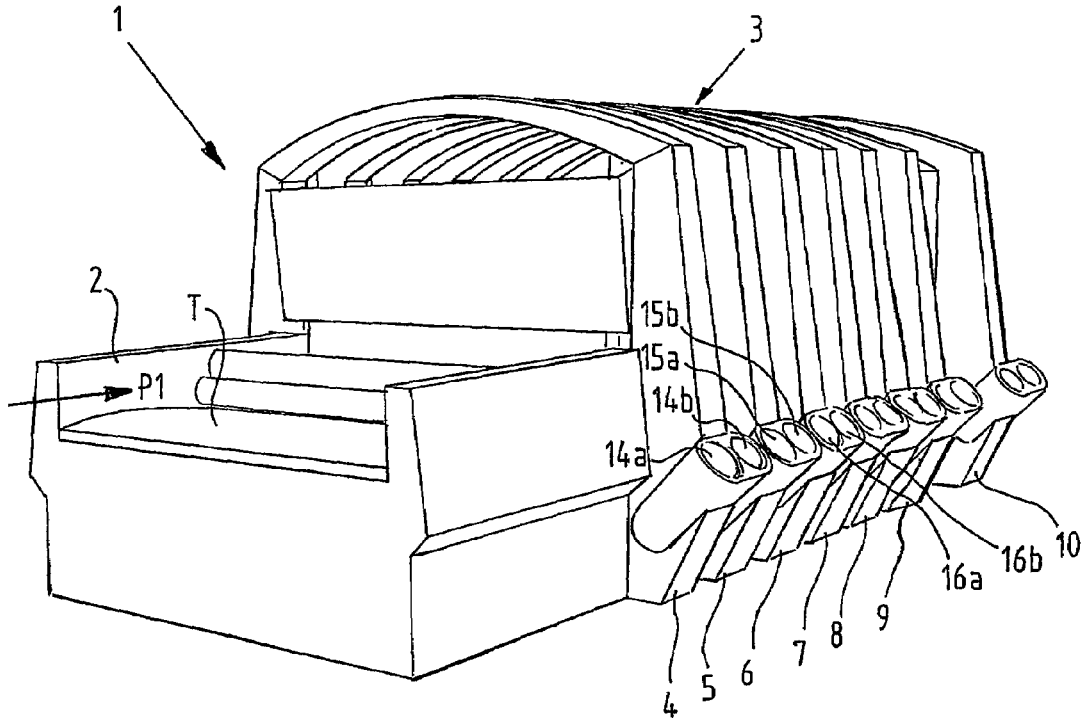
FIG. 2 shows a view in perspective of a textile upgrader according to a first preferred embodiment of the invention.
Figure 3:
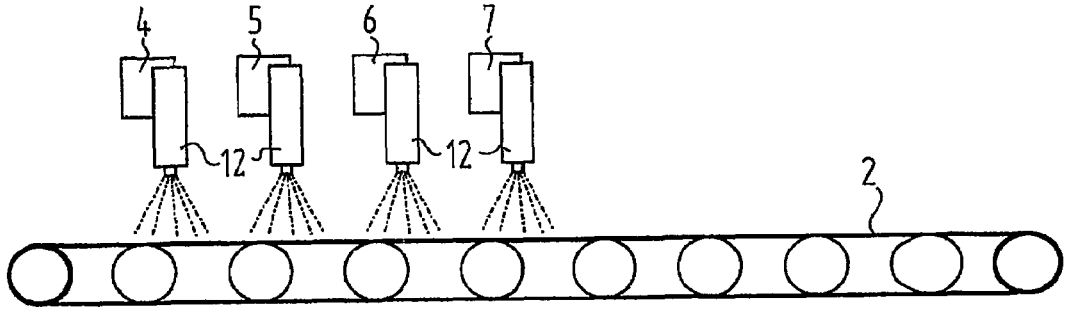
FIG. 3 is a schematic side view of the textile upgrader of FIG. 2.
Figure 4:
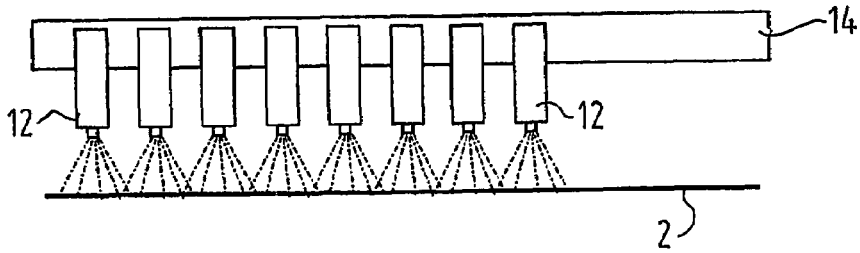
FIG. 4 is a schematic front view of the textile upgrader of FIG. 2.

FIGS. 2-5 show a textile upgrader 1 according to a preferred embodiment of the invention. Textile upgrader 1 is built up of an endless conveyor belt 2 driven using electric motors (not shown). On conveyor belt 2 can be affixed a textile article T which can be transported in the direction of arrow $P_1$ along a housing 3 in which the textile undergoes a number of operations. Finally, the textile is released and discharged in the direction of arrow $P_2$. A large number of nozzles 12 are arranged in housing 3. The nozzles are arranged on successively placed parallel beams 14. A first row 4, a second row 5, a third row 6 and so on are thus formed. The number of rows is random (indicated in FIG. 5 with a dotted line) and depends among other factors on the desired number of operations. The number of nozzles per row is also random and depends among other things on the desired resolution of the designs to be applied to the textile. In a particular preferred embodiment, the effective width of the beams is about 1 m, and the beams are provided with about 29 fixedly disposed spray heads, each having about eight nozzles of 50 μm. Each of the nozzles 12 can generate a stream of droplets of coloured (including black and/or white) substance or other such upgrading material.

In the preferred continuous inkjet method, pumps carry a constant flow of ink through one or more very small holes of the nozzles. One or more jets of ink, inkjets, are ejected through these holes. Under the influence of an excitation mechanism such an inkjet breaks up into a constant flow of droplets of the same size. The most used excitator is a piezocrystal. From the constant flow of droplets of the same size which are now generated must be selected those droplets which must, and those which must not, be applied to the substrate of the textile. For this purpose the droplets are electrically charged or discharged. There are two variations for arranging droplets on the textile. According to the one method an applied electric field deflects the charged droplets, wherein the charged droplets come to lie on the substrate. This method is also referred to as binary deflection. According to another preferred method, also known as the multi-level method, the electrically charged droplets are usually directed to the textile and the uncharged droplets are deflected. The droplets are herein subjected to an electric field which is varied between a plurality of levels such that the final position at which the different droplets come to lie on the substrate can hereby be adjusted.

Figure 5:
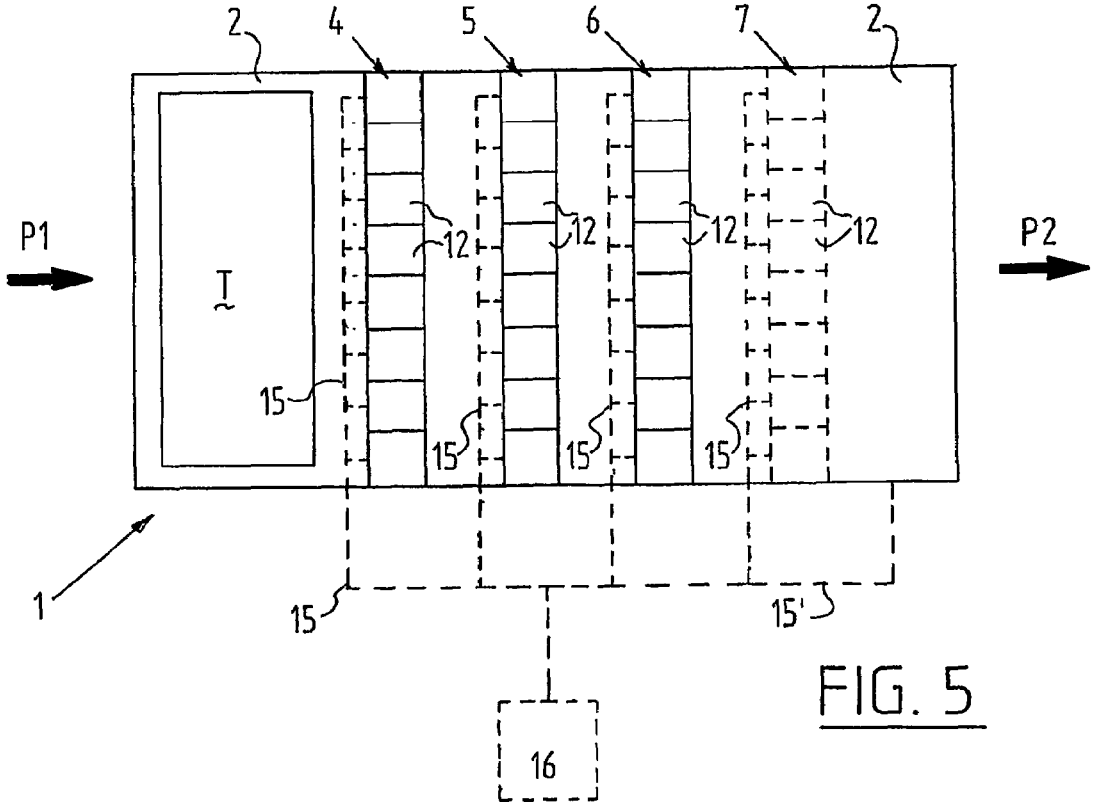
FIG. 5 is a cut-away schematic view of the textile upgrader of FIG. 2.

In FIG. 5 is indicated with dotted lines that the different nozzles 12 are connected (electrically or wirelessly) by means of a network 15 to a central control unit 16, which comprises for instance a microcontroller or a computer. The drive of the conveyor belt 2 is also connected to the control unit via network 15'. The control unit can now actuate the drive and the individual nozzles as required.

Also arranged per row of nozzles 4-11 is a double reservoir in which the coloured substance to be applied is stored. The first row of nozzles 4 is provided with reservoirs 14*a*,14*b*, the second row 5 is provided with reservoirs 15*a*,15*b*, the third row 6 is provided with reservoirs 16*a*,16*b* and so on. The appropriate substance is arranged in at least one of the two reservoirs of a row.

Figure 6:
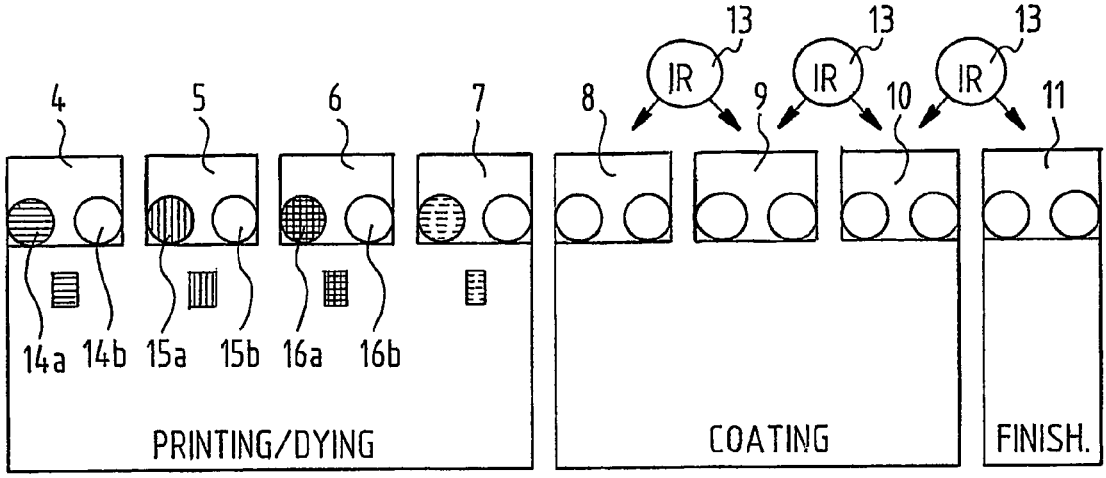
FIG. 6 is a schematic representation of a preferred sequence for performing the different treatment steps.

The different reservoirs are filled with appropriate substances and the nozzles 12 disposed in different rows are directed such that the textile article undergoes the correct treatment. In the situation shown in FIG. 6, reservoir 14*a* of the first row 4 contains cyan-coloured ink, reservoir 15*a* of the second row 5 contains magenta-coloured ink, reservoir 16*a* of the third row 6 contains yellow-coloured ink and reservoir 17*a* of the fourth row 7 contains black coloured ink. The textile article is provided in rows 4-7 with patterns in a painting/printing treatment. The reservoirs of the three subsequent rows 8-10 contain one or more substances with which the treated textile can be coated in three passages. The eighth reservoir 11 contains a substance with which the printed and coated textile can be finished. In this embodiment the textile article T is preferably treated at the position of the fifth to the eighth row with infrared radiation coming from light sources 13 in order to influence the coating of the finishing.

Figure 7:
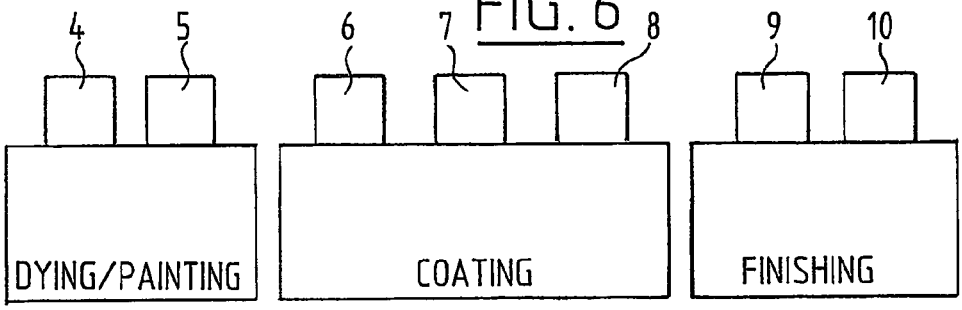
FIG. 7 is a schematic representation of an alternative preferred sequence for performing the upgrading steps.

FIG. 7 shows another situation in which the textile undergoes another treatment sequence. The textile article T is first of all painted by guiding the textile along the first row 4 and second row 5 of nozzles. Both rows of nozzles apply substance of the same colour. In the third to fifth rows (6-8) the painted textile is then coated, whereafter the finishing step is carried out in the sixth and seventh rows (9,10).

Figure 8:
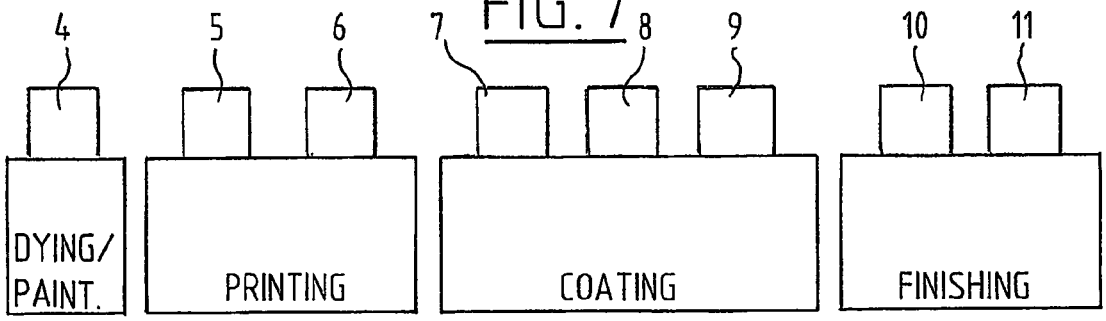
FIG. 8 is a schematic representation of a further preferred sequence for performing the upgrading steps.

In the embodiment shown in FIG. 8, the textile article is first of all guided along the first row (4) of nozzles, which nozzles paint the textile over the full width. The textile article is subsequently guided by means of the conveyor belt along the second row (5) and third row (6), wherein patterns are printed onto the painted textile. The textile is then guided along the fourth to sixth rows (7-9) to coat the painted and printed textile in three passages, whereafter a final finishing treatment step is performed in the seventh and eighth rows (10,11).

It is possible to treat different successively transported textile articles in different ways, in some cases even without the transport of the textile therein having to be interrupted. It is for instance possible by means of a correct directing of nozzles 12 to provide the successively supplied textile articles with designs which differ in each case. It is also possible to have different substances applied to the textile through a correct choice of the reservoirs. The first reservoirs (14*a*, 15*a*, 16*a*) are for instance used in each case for a first type of textile, while the second reservoirs (14*b*, 15*b*, 16*b*) are used for another type of textile.

In order to determine the environmental advantages of the present invention, use can be made of an example of a representative upgrading process in which a substrate passes through four cycles of unit operations for the purpose of painting, followed by four cycles for the coating and finally two cycles for the finishing. The quantification is based on the production of a 1,800 meter long and about 1.6 meter wide substrate of bleached and dried cotton with a weight of 100 grams per square meter of substrate. The painting, coating and finishing are herein each performed in one process run, with the necessary post-treatments and/or pre-treatments between these process runs. If the treatments can be carried out in one process run, the environmental advantages will therefore be even greater.

In the traditional upgrading process, practically every component (painting, coating and finishing) takes place in and/or with a highly aqueous solution. In the digital process according to the invention a highly concentrated solution is sprayed directly onto the substrate with a precisely controlled dosage. Less water is hereby used. For the purpose of rinsing/washing out excess chemicals and auxiliary chemicals, practically every cycle of unit operations comprises a rinsing step. The number of rinsing steps can be reduced from ten in the existing process (four times painting, four times coating and twice finishing) to three in the present digital process (i.e. once painting, once coating and once finishing). Seven fewer rinsing steps are therefore needed. This means that a considerable reduction in the water consumption can already be realized by curtailing the rinsing. The total reduction in the water consumption is in many cases more than 90%.

The energy consumption can also be reduced considerably, since among other things forced drying is not necessary, or is only necessary to a very limited extent, rinsing with hot/warm rinsing water is not necessary, or only to a very limited extent, and the mechanical handling of the substrate is very greatly reduced.

In the known upgrading process drying usually takes place between the different components, and also within components when a cycle has to be carried out a number of times. The substrate can contain up to several times its own weight of water. Drying generally takes place in two phases. In the first phase the greater part of the water is removed from the substrate mechanically. In the second phase there follows thermal drying, wherein the remaining water present in the substrate is evaporated.

However, because the present digital upgrading process is performed almost without water, no water, or practically no water, has to be evaporated, such as for instance by drying, between the different upgrading steps and after the final upgrading step. A very considerable energy-saving is hereby realized. The limited drying which is necessary in some cases can be realized in most cases by means of directional UV-driers.

In digital processes there is no, or very limited, washing of the substrate required. Drying is therefore also not necessary, or only necessary to a very limited extent. with digital upgrading it will also be possible to considerably reduce the number of mechanical operations, including transport of the substrate between the different upgrading operations, compared to the known upgrading process. The electrical energy consumption will hereby also decrease considerably.

All in all, a reduction in the energy consumption by more than 90% can be realized.

With current production techniques about 150 grams of wet substances (chemicals) are further applied per square meter. In digital printing, owing to a more precise dispensing, lower pressure and less absorption in the textile, the quantity of chemical substances to be applied can be reduced to about 50 grams of wet substance per square meter. It is hereby possible to make a saving of about 66% in the chemicals. The saving relates not only to the primary chemicals but also to the additives, such as salts, with which the substrate is pre-treated in the digital process in order to facilitate the action, fixation and/or reactivity of the primary chemicals. It is expected that a saving of 66% can also be made on these additives.

Finally, the waste water production and the contamination impact of the waste water can be reduced by more than 90%.

The invention is not limited to the above described preferred embodiments thereof. The rights sought are rather defined by the following claims, within the scope of which many modifications can be envisaged. It is noted here that the term "textile article" is used herein for any substrate in general, or more specifically any fabric, and then in particular clothing, flags, tent-cloths etc., on which the operations of painting, coating and/or finishing (and printing) can be performed.

What is claimed is:

1. Method for upgrading textile articles made from cloth, using an upgrading device, the device comprising a number of digitally controlled nozzles for applying jets of droplets of one or more substances to the textile articles, in addition to a conveyor for transporting the textile articles past the nozzles, wherein the nozzles are ordered in a number of successively placed rows extending transversely of the transporting direction of the textile article, the method comprising the steps of:

a) affixing a first textile article to the conveyor to substantially prevent relative movement there-between;

b) guiding the first textile article past a first row of nozzles;

c) performing with the first row of nozzles one of the operations of painting, coating or finishing of the first textile article carried there-past;

d) subsequently guiding the first textile article past a second row of nozzles;

e) performing with the second row of nozzles another of the operations of painting, coating or finishing of the first textile article carried there-past; and repeating steps a to e for a second textile article wherein the operation carried out in step c) or e) does not comprise printing and is different for the first and second articles.

2. Method as claimed in claim 1, comprising of painting the first or second textile article with a first row of nozzles, subsequently coating the painted textile article with a second row of nozzles and finally finishing the coated textile article with a third row of nozzles.

3. Method as claimed in claim 1, comprising of coating the first or second textile article with a first row of nozzles, subsequently finishing the coated textile article with a second row of nozzles.

4. Method as claimed in claim 1, applied in a device of the continuous inkjet and multi-level deflection type, the method comprising the steps of:

feeding substance to the nozzles in almost continuous flows;

breaking up the continuous flows in the nozzles to form respective droplet jets;

electrically charging or discharging the droplets;

applying an electric field;

deflecting the droplets with the electric field such that they are deposited at suitable positions on the first or second textile article.

5. Method as claimed in claim 4, comprising of generating per nozzle at least 100,000 droplets per second.

6. Method as claimed in claim 1, comprising of applying substances from two or more successively placed rows of nozzles per treatment step of painting, coating or finishing.

7. Method as claimed in claim 6, comprising of arranging in any order, a cyan-coloured substance, a magenta-coloured substance, a yellow-coloured substance and a black substance in at least four successive rows of nozzles.

8. Method as claimed in claim 6, comprising of arranging a substance of a mixed colour in at least four rows of nozzles.

9. Method as claimed in claim 1, wherein the treatment step of painting comprises of applying the substance substantially uniformly over the width of the textile article.

10. Method as claimed in claim 1, wherein the treatment of the first or second textile article comprises printing of the textile article in addition to painting, coating and/or finishing.

11. Method as claimed in claim 10, wherein the treatment step of printing comprises of applying one or more patterns of the substance to the textile article.

12. Method as claimed in claim 1, wherein the treatment step of coating the first or second article comprises of applying a substance in a thin layer to the surface of the textile article.

13. Method as claimed in claim 1, wherein the treatment step of finishing the first or second textile article comprises of changing the physical properties of a substance previously applied to the textile article.

14. Method as claimed in claim 13, wherein the treatment step comprises of irradiating the textile article with infrared radiation.

15. Method as claimed in claim 1, comprising of directing the individual nozzles with a central control.

16. Method as claimed in claim 1, comprising of transporting the first or second textile article along nozzles placed on either side of the textile article for double-sided upgrading thereof.

17. Method as claimed in claim 1, comprising of painting the substance in one process run.

18. Method as claimed in claim 1, comprising applying coating and finishing substances in one process run.

19. Method as claimed in claim 1, comprising applying painting, coating and finishing substances in one process run.

20. Method as claimed in claim 1, wherein the second textile article is a downstream portion of the same article as the first article.

21. Method for digitally upgrading a textile article made from cloth, using an upgrading device, the device comprising a continuous multi-level deflection type inkjet device having a number of nozzles for applying one or more substances to the textile article, in addition to a conveyor for transporting the textile article past the nozzles, wherein the nozzles are ordered in a number of successively placed rows extending transversely of the transporting direction of the textile article, the method comprising the steps of:

guiding a textile article past a first row of nozzles;

performing with the first row of nozzles one of the operations of painting, coating or finishing of the textile article carried there-along;

subsequently guiding the textile past a second row of nozzles; and performing with the second row of nozzles another of the operations of painting, coating or finishing of the textile article carried there-past; wherein the operations of painting, coating or finishing do not comprise printing and do comprise the steps of:

feeding substance to the nozzles in almost continuous flows;

breaking up the continuous flows in the nozzles to form respective droplet jets;

electrically charging or discharging the droplets;

applying an electric field;

deflecting the droplets with the electric field such that they are deposited at suitable positions on the textile article.

* * * * *